United States Patent [19]

Wyatt et al.

[11] 4,216,708

[45] Aug. 12, 1980

[54] FUME CONTAINMENT

[75] Inventors: John G. Wyatt, Hall Green; Kenneth R. Parker, Sutton Coldfield, both of England

[73] Assignee: Lodge-Cottrell Limited, Birmingham, England

[21] Appl. No.: 959,547

[22] Filed: Nov. 13, 1978

[30] Foreign Application Priority Data

Nov. 21, 1977 [GB] United Kingdom ..... 48328/77

[51] Int. Cl.[2] ..... F23J 11/08

[52] U.S. Cl. ..... 98/36; 98/115 R; 266/159; 266/196; 266/231

[58] Field of Search ..... 98/36, 115 R; 266/158, 266/159, 196, 231

[56] References Cited

U.S. PATENT DOCUMENTS

| | | | |
|---|---|---|---|
| 1,896,951 | 2/1933 | Hahn | 98/115 R |
| 2,074,317 | 3/1937 | Allan et al. | 98/36 |
| 2,598,393 | 5/1952 | Kalling et al. | 266/158 |
| 3,215,058 | 11/1965 | Anderson | 98/36 |
| 3,224,750 | 12/1965 | Baum | 266/158 |
| 3,708,414 | 1/1973 | Laube | 98/115 R |
| 3,760,446 | 9/1973 | Payton | 98/36 |
| 3,773,000 | 11/1973 | Applegate | 98/36 |
| 3,863,907 | 2/1975 | Pierson, Sr. et al. | 266/196 |
| 3,880,061 | 4/1975 | Hensiek et al. | 98/36 |
| 3,994,210 | 11/1976 | Davis | 98/115 R |

FOREIGN PATENT DOCUMENTS

| | | | |
|---|---|---|---|
| 1376804 | 12/1974 | United Kingdom | 98/115 R |
| 1400224 | 7/1975 | United Kingdom | 98/115 R |

*Primary Examiner*—Ronald C. Capossela

*Attorney, Agent, or Firm*—John N. Hazelwood; Roy L. Van Winkle

[57] ABSTRACT

A method and apparatus for containing fume emanating from the surface of molten iron or slag flowing along an open stretch of runner in a casthouse comprises directing an air curtain across the open stretch of runner.

16 Claims, 4 Drawing Figures

FUME CONTAINMENT

This invention is concerned with improvements in or relating to fume containment.

In for example, blast furnace technology, it is common to run molten iron or slag from a blast furnace along open runners. The molten metal or slag generates noxious fume causing environmental pollution locally and at times more widespread.

Closing of the runners would be one solution to this pollution problem, but in practice it is desirable to have direct maintenance and visual access to the hot metal flow routes in certain places, e.g. adjacent to gates and dams.

Similar problems can arise in other technologies, for example flow of molten metals other than iron, and indeed, flow of any liquid material from which a fume emanates, and where it is desired either for environmental reasons or otherwise that the fume should be contained.

It is an object of the present invention to provide an improved method of containing fume emanating from an open runner.

The invention provides a method of containing fume emanating from the surface of liquid material flowing along an open stretch of runner, wherein a gas curtain is directed across the open stretch of runner.

The invention also provides a liquid flow assembly which comprises (a) a runner arranged for flow of liquid material therealong and comprising an open stretch; (b) a gas flow assembly arranged to direct a gas curtain across the open stretch of runner to contain fume emanating from the surface of the liquid material when the assembly is in use; and (c) an exhaust assembly into which the gas curtain flows when the assembly is in use.

Where the liquid material is e.g. molten iron, steel or slag the gas curtain may be an air curtain, but for example, where molten aluminium is involved, an inert gas may be used.

There now follows a description, to be read with reference to the accompanying drawings, of an assembly embodying the invention. This description, which is also illustrative of method aspects of the invention, is given by way of example only, and not by way of limitation.

Figure 1:
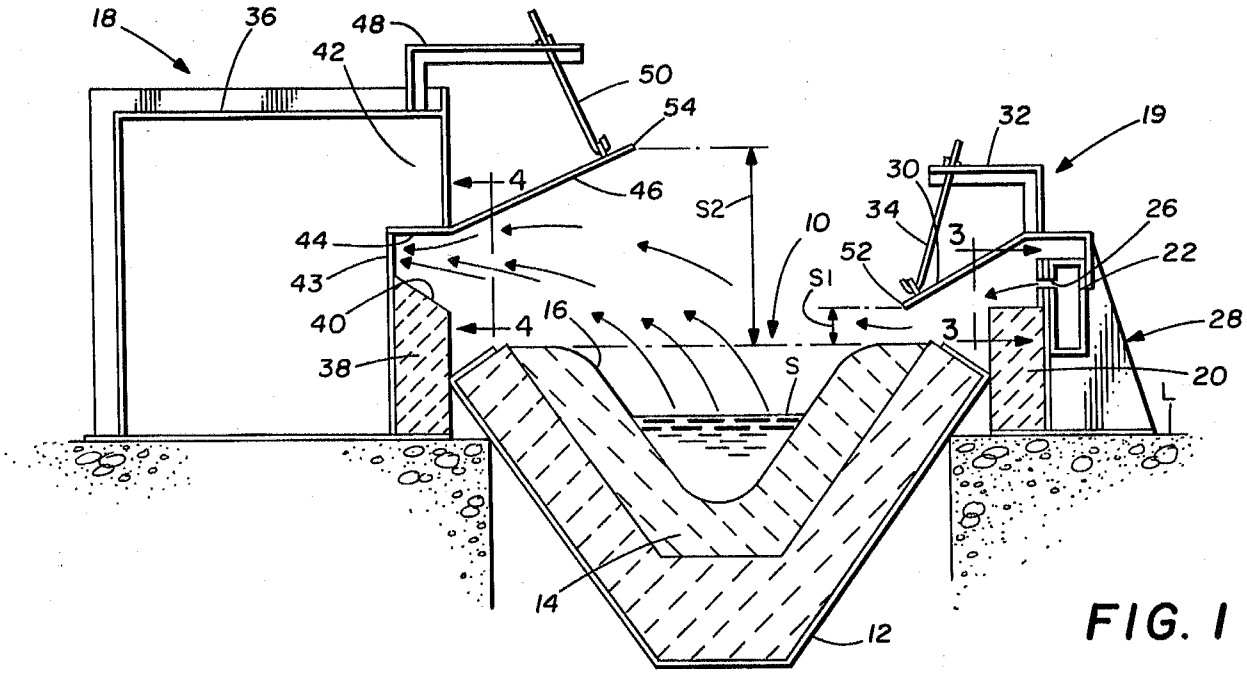
FIG. 1 shows a cross-sectional end view of the assembly embodying the invention.
Figure 3:
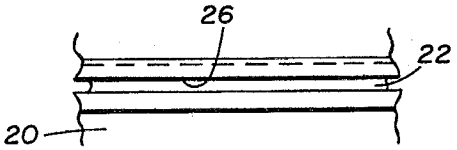
FIG. 3 shows an enlarged broken view on the line III—III of FIG. 1.
Figure 4:
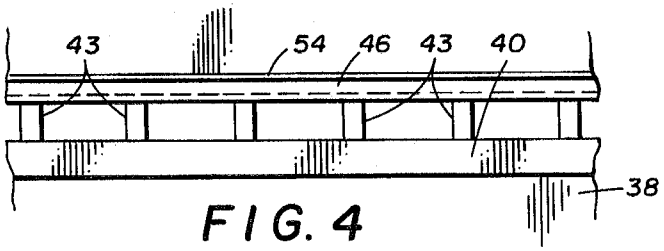
FIG. 4 shows an enlarged broken view on the line IV—IV of FIG. 1.
Figure 2:
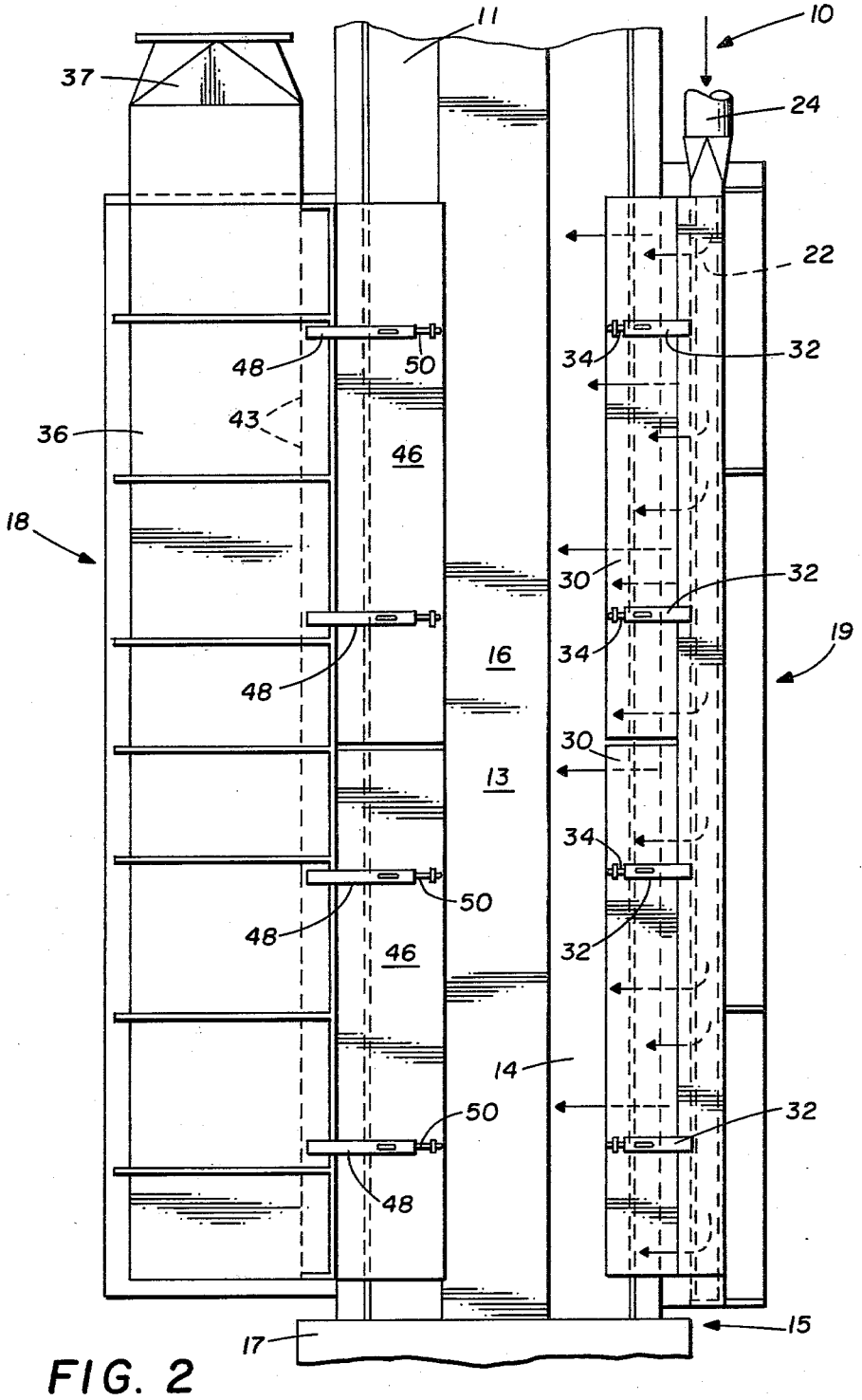
FIG. 2 shows a corresponding plan view.

The assembly embodying the invention is located within a cast house and comprises a generally V-shaped runner 10, along which molten iron or molten slag from a blast furnace (not shown) flows; for convenience the following description is given solely with reference to molten iron. The runner 10 comprises a short open stretch 11 leading from the blast furnace to an open stretch 13; and means is provided for directing a horizontal air curtain across the open stretch 13; the air curtain is directed above surface S of the molten iron. The air curtain directing means does not extend over the stretch 11 for operational reasons of access, and the stretch 11 is provided with a canopy (not shown) to collect fume emanating from the molten metal surface; any escape of fume here is minimal. The stretch 13 is followed by a stretch 15 totally enclosed by a horizontal plate 17.

The runner 10 leads to a ladle filling station (not shown) within the cast house, and the stretch 17 may be followed by further stretches corresponding to the stretch 13 with air curtains and further totally enclosed sections. Fume is readily contained at the totally enclosed stretches, and the air curtains serve to contain the fume in areas where access to the runner is more important.

The runner 10 comprises a metal shell 12 extending below ground level L and a two-part (FIG. 1) refractory lining 14 defining an open trough 16, along which the molten iron flows.

The means for directing the air curtain comprises a gas flow assembly 19 adjacent the runner 10 on one side thereof, and an exhaust assembly 18 adjacent the runner 10 on the other side thereof. In operation, air flows from the flow assembly 19 into the exhaust assembly 18 to provide the air curtain.

The gas flow assembly 19 comprises a refractory wall 20 extending upwardly from the ground level L, and the wall 20 supports a rectangular duct 22 which is in communication with the atmosphere via another duct 24, in which is included a fan (not shown). The duct 22 is spaced from the runner 10 by the wall 20. An upper end portion of the duct 22 comprises a horizontally elongated slot 26 through which air is blown when the fan is operating, and it will be realised that the air curtain originates at the slot 26.

A shroud 28 extends from behind the duct 22 at the ground level L over the duct 22 and horizontally beyond the duct 22 towards the trough 16; the shroud 28 is spaced above the duct 22 and the refractory wall 20. Two planar baffle plates 30, which may be refractory lined, are mounted on a leading edge portion of the shroud 28, and extend towards the trough 16, terminating short of the trough 16; it will be realised that in other stretches of the runner 10 more or less than two baffle plates 30 may be provided according to the length of the particular stretch. The assembly 16 also comprises brackets 32 supported on the shroud 28, and a strut 34 extends from each bracket 32 to the leading edge portion of the appropriate baffle plate 30. Both baffle plates 30 are inclined downwardly in the direction towards the exhaust assembly 18 at the same angle.

The exhaust assembly 18 comprises a rectangular duct 36, a lower portion of which is spaced from the runner 10 by a refractory wall 38, having a surface 40 which is inclined downwardly towards the runner 10. The duct 36 is connected to another duct 37 which includes an exhaust fan (not shown). The duct 36 comprises an overhanging portion 42 comprising an imperforate horizontal surface 44, which defines together with the inclined surface 40, an inlet mouth to the duct 36, extending horizontally along the runner 10 and converging in the direction of flow into the exhaust assembly 18. A plurality of horizontally spaced vertical slats 43 extend between the surfaces 40, 44 at the rear of the inlet mouth, the duct being open between the slats 43.

Two planar baffle plates 46, which may be refractory lined, are mounted on the overhanging duct portion 42, adjacent a leading edge portion of the surface 44. Each baffle plate 46 extends towards and over the trough 16, terminating short of the mid-point of the trough 16. The assembly 18 also comprises brackets 48 supported on the duct 36, and a strut 50 extends from each bracket 48 to a leading edge portion of the appropriate baffle plate 46. Both baffle plates 46 are inclined upwardly in the direction towards the gas flow assembly 19 at the same angle, the upper edges 54 of the baffle plates 46 being higher than the lower edges 52 of the baffle plates 30.

In operation, an air curtain is provided across the runner 10 by air blown out of the slot 26 and flowing past the lower edge portions of the baffles 30 generally horizontally across the runner 10 above the surface S under the baffles 46 and into the duct 36 via the mouth portion 40, 44, and the spaces between the slats 43; the exhaust fan is operating at this time to provide suction at the mouth portion.

From the exhaust assembly 18 the gas is conducted via the duct 37 to gas cleaning means prior to discharge to the atmosphere.

The inclination of the baffle plates 30 to the horizontal is, for example, from 5° to 50°, e.g.about 30°. The vertical spacing s1 between the lower edges 52 of the baffle plates 30 and the runner 10, is for example, from 2 to 6 inches e.g. about 3 inches.

The inclination of the baffle plates 46 to the horizontal is, for example, from 5° to 60°, e.g. about 30°. The vertical spacing s2 between the upper edges 54 of the baffle plates 46 and the runner 10 is, for example, from 10 to 32 inches, e.g. about 15 inches. The angle of the surface 40 to the horizontal is, for example, from 5° to 60°, e.g. about 30°, thus it will be realised that the modulus of the angle of the baffle plates 46 may be the same as that of the surface 40.

The vertical gap of the slot 26 is from 0.25 to 1 inch, e.g. about 0.5 inches.

The slats 43 are not necessarily evenly spaced, but there are, for example, on average from 2 to 6 slats 43 per foot of duct 36 along the runner 10, e.g. about 4 slats per foot. The vertical height of the slats 43(which is also the gap of the inlet mouth at its convergent minimum) is from 3 to 12 inches, e.g. about 5 inches.

The specific flow rate of gas exhausted through the duct 36 is, for example, at least 900 cubic feet per minute per foot of duct 36 along the runner 10. The specific flow rate of gas through the slot 26 is, for example, from 30 to 300 cubic feet per minute per foot of duct 22 along the runner 10 e.g. about 70 cubic feet per minute per foot of duct. Under these conditions, it is believed that substantially all fume emanating from the length of runner covered by the assemblies 16, 18, can be removed via the exhaust assembly 18.

We claim:

1. A flow assembly for molten material which comprises:

(a) refractory-lined runner means for flow of molten material therealong and comprising an open stretch;

(b) gas flow means adjacent one side of the runner for directing a gas curtain across the open stretch of runner to contain fume emanating from the surface of the molten material;

(c) gas cleaning means;

(d) exhaust means adjacent the other side of the runner for exhausting the gas curtain through the gas cleaning means; and wherein:

(e) the gas flow means comprises a baffle which is downwardly inclined towards the exhaust means; and (f) the exhaust means comprises a baffle which is upwardly inclined towards the gas flow means.

2. An assembly according to claim 1, wherein the molten material is a molten metal.

3. An assembly according to claim 1, wherein the molten material is iron or slag.

4. An assembly according to claim 1, wherein the open stretch of runner means is located within a casthouse.

5. An assembly according to claim 1, wherein the gas curtain is an air curtain and the gas flow means comprises an inlet duct communicating with the atmosphere.

6. An assembly according to claim 1, wherein the gas flow means presents elongated slot means for originating the gas curtain.

7. An assembly according to claim 6, wherein the gap of the slot is about 0.25 to 1 inch.

8. An assembly according to claim 1, wherein the baffle of the gas flow means is inclined to the horizontal at an angle of about 5° to 50°.

9. An assembly according to claim 1, wherein the spacing between the lower edge of the baffle of the gas flow means and the runner is about 2 to 6 inches.

10. An assembly according to claim 1, wherein the exhaust means presents an inlet mouth which converges in the direction of flow into the exhaust means.

11. An assembly according to claim 10, wherein the gap of the inlet mouth at its convergent minimum is about 3 to 12 inches.

12. An assembly according to claim 10, wherein the inlet mouth is defined by a generally horizontal upper surface and an inclined lower surface.

13. An assembly according to claim 12, wherein the angle to the horizontal of the inclined surface is about 5° to 60°.

14. An assembly according to claim 1, wherein the baffle of the exhaust means presents an upper edge, the baffle of the flow means presents a lower edge, and the upper edge of the baffle of the exhaust means is higher than the lower edge of the baffle of the flow means.

15. An assembly according to claim 1, wherein the baffle of the exhaust means presents an upper edge and the vertical spacing between the upper edge of said baffle and the runner is about 10 to 32 inches.

16. An assembly according to claim 1, wherein the baffle of the exhaust means is inclined to the horizontal at an angle of about 5° to 60°.

* * * * *